US006824397B1

(12) United States Patent
Carreras

(10) Patent No.: US 6,824,397 B1
(45) Date of Patent: Nov. 30, 2004

(54) SYSTEM FOR SECURING THE ELECTRICAL CONNECTION IN FUSES WITH AN INCORPORATED FEMALE TERMINAL

(75) Inventor: Joan Carreras, Valls (ES)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 10/709,257

(22) Filed: Apr. 24, 2004

(51) Int. Cl.[7] ..... H01R 9/09
(52) U.S. Cl. ..... 439/76.2; 439/378; 439/382
(58) Field of Search ..... 439/76.2, 949, 439/378, 382, 621

(56) References Cited

U.S. PATENT DOCUMENTS 6,261,105 B1 * 7/2001 Uezono ..... 439/76.2
6,428,331 B1 * 8/2002 Yamakawa et al. ..... 439/76.2
6,736,648 B2 * 5/2004 Terunuma et al. ..... 439/76.2
2004/0147158 A1 * 7/2004 Hobbs et al. ..... 439/378

* cited by examiner

*Primary Examiner*—Tho D. Ta
(74) *Attorney, Agent, or Firm*—Bill C Panagos

(57) ABSTRACT

Specially applicable to the fuse holder boxes (7) connectable to a distribution box (1) in the electrical installations of automotive vehicles, wherein housings (2) are arranged in said distribution box (1) for the male terminals (3), which upwardly project therefrom and which remain axially immobilized, in working mode, as a result of respective resilient retainers (4), whilst the female terminals complementary to said male terminals (3) and corresponding to the respective fuses are arranged in the fuse holder boxes (7), the invention consists of providing the fuse holder boxes (7) with extensions (9) of its own plastic material, of suitable number and position so as to act on the resilient retainers (4) in the assembly of said fuse holder box on the distribution box (1), immobilizing them against the male terminals (3) and, in turn, consequently immobilizing the latter against axial forces and vibratory movements, preventing said male terminals (3) from being able to move and moreover to uncouple from the distribution box (1) under any circumstance.

2 Claims, 2 Drawing Sheets

SYSTEM FOR SECURING THE ELECTRICAL CONNECTION IN FUSES WITH AN INCORPORATED FEMALE TERMINAL

BACKGROUND OF INVENTION

FIELD OF THE INVENTION

The present invention refers to a system which has been specially conceived to secure the electrical connection in fuses with an incorporated female terminal, with respect to male terminals arranged in turn in the corresponding distribution box.

OBJECT OF THE INVENTION

The object of the invention is to prevent the occurrence of an axial shifting of the male terminals during the installation of the fuse holder box in the distribution box, and more specifically during the insertion of the male terminals belonging to the distribution box in the female terminals of the fuses, with the consequent loss of electrical connection.

The system of the invention proves especially applicable in the scope of the automobile industry, especially in the manufacture of electrical distribution boxes and the corresponding and complementary fuse holder boxes thereof.

In the preferred scope of practical application of the invention, that of electrical distribution boxes used in automotive vehicles, it is common for housings to be arranged in said boxes for the male terminals of the different circuits, said circuits being subsequently closed by means of respective fuses provided with female terminals which are complementary to the aforementioned male terminals.

The male terminals are introduced through the lower part of the distribution box, and are assisted by resilient side retainers provided with a lug of a triangular or right-angled trapezium profile, such that said lug allows and facilitates the installation of the corresponding male terminal, until reaching a small window in the terminal itself, the interior of which it gains access to by elastic recovery of the retainer itself and where it immobilizes the male terminal once this suitably projects from the upper base of the distribution box, preventing the retraction thereof when this enters the female terminal of the complementary fuse.

This solution, perfectly valid from the theoretical point of view, in practice presents assembly problems derived from the fact that when an anomaly occurs in the meeting between male terminal and female terminal, the excess force applied on introduction of the male terminal belonging to the distribution box into the female terminal of the fuse arranged in the fuse box generates in turn an excess pressure of the male terminal with respect to the corresponding resilient retainer, which can end up forcing the latter to uncouple its lug from the window of the male terminal, as a result of which this is pushed and shifted outwards from the distribution box, through the lower side thereof, not penetrating into the female terminal of the fuse and, consequently, the due electrical connection between both terminals not being carried out.

In other circumstances, this situation is reached as a result of the vibrations of the vehicle in the normal operation thereof, vibrations which can also cause the uncoupling of the lug or resilient retainer from the complementary window of the male terminal, as a result of which, and also due to the same vibrations, the male terminal is in a position to begin a progressively downward movement, uncoupling itself from the female terminal, until the electrical connection is undone.

DESCRIPTION OF THE INVENTION

The system proposed by the invention solves the problems previously set forth in an entirely satisfactory manner, securing the electrical connection between each and every one of the male terminals of the distribution box and the complementary female terminals thereof belonging to the fuses, which connection is maintained undisturbed indefinitely over time.

To this end and more specifically, said system consists of providing the fuse holder box, in which the fuses with a female terminal are housed, with lower extensions which penetrate in the distribution box before the male terminals thereof do so in the female terminals of the fuse holder box, these fixed extensions of the fuse holder box being of suitable number and position so as to laterally act on the resilient retainers for fixing the male terminals, such that once the fuse holder boxes have been duly installed in the distribution box, or even before the electrical connection between terminals is produced, a lateral immobilization of the resilient retainers is produced, inevitably ensuring that the male terminals will in turn remain immobilized in their respective housings, both against any anomalous axial or longitudinal force and against the effects of the vibrations.

BRIEF DESCRIPTION OF DRAWINGS

In order to complement the description being carried out and for the purpose of helping to better understand the features of the invention, according to a preferred practical embodiment thereof, a set of drawings is attached as an integral part of said description, wherein the following are represented with an illustrative and non-limiting character.

Finally.

DETAILED DESCRIPTION

Figure 1:
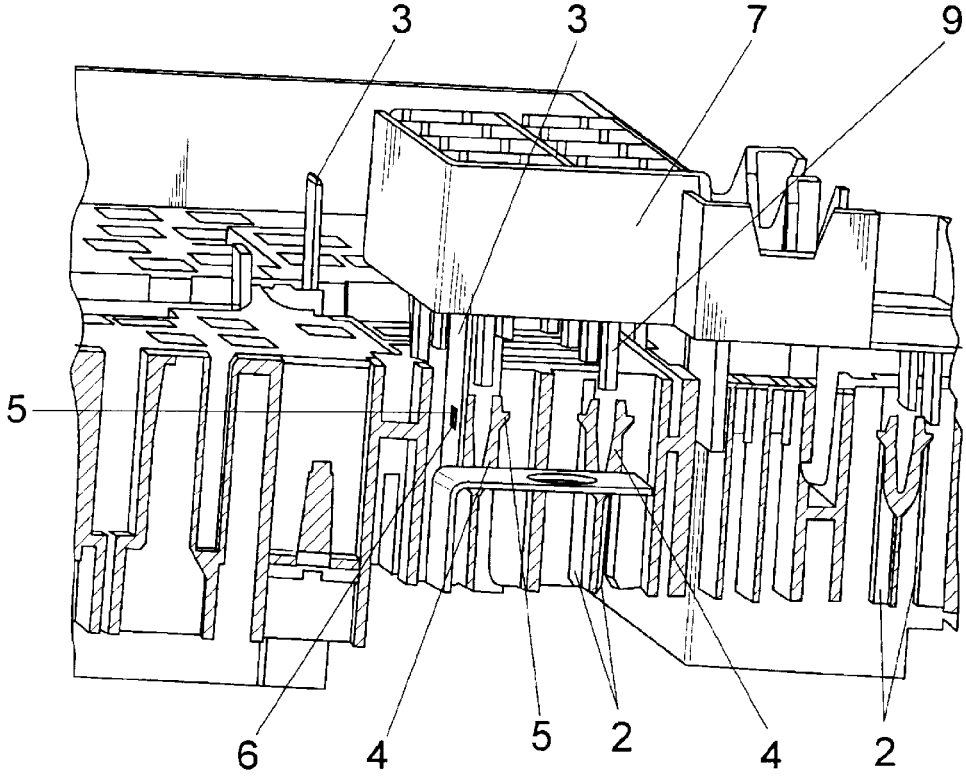
FIG. 1 shows a perspective view of a partial detail of a distribution box, in which a fuse holder box with an incorporated female terminal appears in a disassembled position, provided with the system for securing the electrical connection which constitutes the object of the present invention.
Figure 2:
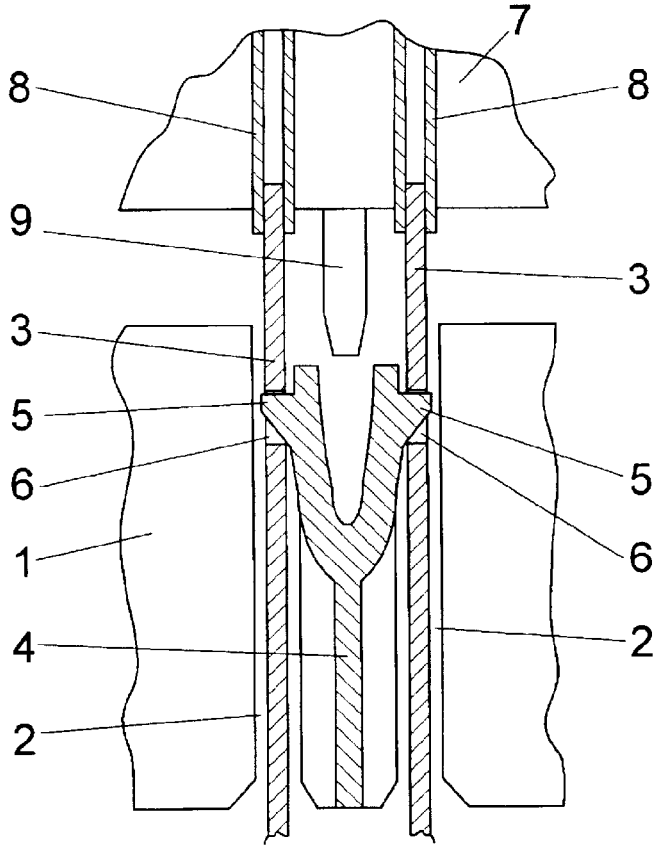
FIG. 2 shows a side elevation view of an enlarged detail of the elements of the previous figure, at the level of a pair of laterally adjacent male terminals, with the complementary female terminals thereof.
Figure 3:
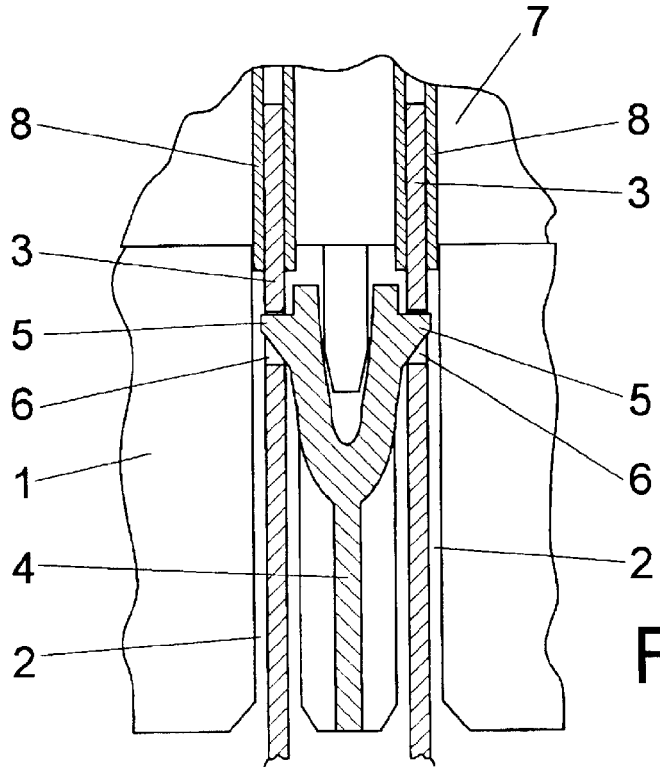
FIG. 3 shows the same detail as the previous figure, after the electrical connection of the fuses to the male terminals of the distribution box.

In the described figures, a distribution box appears with reference number (1), in which a plurality of housings (2) are defined for respective male terminals (3), which gain access to said housings (2) through the lower end thereof, i.e. through the lower base of the distribution box (1), which substantially project from the upper side or base thereof in the definitive assembly position, and which remain immobilized in the specific working position with the collaboration of resilient retainers (4), obtained based on the same plastic material constituting the distribution box (1), said resilient retainers (4) being provided with respective lugs (5) of a triangular or right-angled trapezium profile, intended to lock themselves into respective windows (6) operatively made in the male terminals (3), such that in the assembly of the latter, the inclined plane defined by the lugs (5) favors the retraction or resilient deformation of the retainers (4) for the access of said male terminals (3), and when these reach their situational or positional limit, the lugs (5) meet the windows (6) and penetrate into the interior thereof by elastic recovery, blocking the terminals (3) in an axial direction, especially against a backward movement effect towards the downward shifting thereof.

The fuse holder boxes (7) are arranged on the upper base of the distribution box (1) with their corresponding female terminals (8), intended to receive the upper projecting end of the male terminals (3) arranged in the distribution box (1).

The system of the invention consists of providing the fuse holder boxes (7) with extensions (9) of the same plastic material constituting said boxes (7), which substantially project from the lower side, that which is adapted to the distribution box (1), said extensions (9) being of suitable number and position so as to act on the resilient retainers (4) of the distribution box in the assembly of the fuse holder boxes (7), immobilizing them in order for the male terminals (3) to in turn remain immobilized, given that in this position of penetration of the extensions (9), these keep the lugs (5) of the retainers (4) immobilized within the windows (6) of the male terminals (3), a locking situation which remains invariable both against axial forces received by said terminal (3) and against vibratory effects.

For the purpose of achieving the maximum functional effectiveness of the aforementioned extensions (9), these have a length such that they act in the coupling of the fuse holder boxes (7) to the distribution box (1) before the male terminals (3) of the latter act on the female terminals (8) of the fuses, i.e. the locking of the male terminals (3) by means of the immobilization of the resilient retainers (4) which assist them already occurs before an abnormal axial force can occur on the male terminals (3).

What is claimed is:

1. A system for securing the electrical connection in fuses with an incorporated female terminal which, being of special application to electrical distribution boxes used in the automobile industry, on which a plurality of male terminals are arranged, projecting therefrom, which can be plugged in respective female terminals belonging to fuses installed on fuse holder boxes complementary to said distribution box, and where said male terminals remain axially immobilized in respective housings of the distribution box as a result of resilient retainers of plastic material belonging to the distribution box itself, is characterized in that the fuse holder box (7) incorporates a plurality of extensions (9) projecting from its lower base or side for coupling to the distribution box (1), of suitable number and position so as to laterally act on the resilient retainers (4) for fixing the male terminals (3), such that the immobilization of said retainers (4) implies the immobilization of the terminals (3) in the respective housings (2) thereof, both against axial excess forces and against vibratory movements.

2. A system for securing the electrical connection in fuses with an incorporated female terminal according to claim 1, characterized in that the length of the aforementioned extensions (9) is such that said extensions act on the resilient retainers (4) in the coupling of the fuse holder boxes (7) before the male terminals (3) reach the corresponding female terminals (8) of the fuses.

* * * * *